US005331752A

United States Patent [19]

Johnson et al.

[11] Patent Number: 5,331,752

[45] Date of Patent: Jul. 26, 1994

[54] SKATE WITH DETACHABLE SHOE

[75] Inventors: Robert K. Johnson, Blaine; Brennan J. Olson, Minneapolis, both of Minn.; Michel D. Arney, Needham; Jack J. Curley, Jr., Dunstable, both of Mass.

[73] Assignee: Rollerblade, Inc., Minnetonka, Minn.

[21] Appl. No.: 820,382

[22] Filed: Jan. 14, 1992

[51] Int. Cl.[5] ..... A43B 5/04; A63C 17/02

[52] U.S. Cl. ..... 36/115; 36/54; 36/50.1; 36/120; 280/11.22

[58] Field of Search ..... 280/11.3, 11.22, 11.27; 36/120, 131, 115, 54, 50.1

[56] References Cited

U.S. PATENT DOCUMENTS

| | | | |
|---|---|---|---|
| 25,295 | 8/1859 | Wheeler . | |
| 38,173 | 4/1863 | Marvin | 280/11.3 |
| 920,079 | 6/1869 | Meyer | 280/11.3 |
| 1,835,446 | 12/1931 | Tracey . | |
| 2,168,820 | 8/1939 | Edstrom . | |
| 2,998,260 | 8/1961 | Meyer | 280/11.3 X |
| 3,228,707 | 1/1966 | Davis et al. . | |
| 3,892,111 | 8/1974 | Nicholls . | |
| 3,963,251 | 6/1976 | Miano | 36/115 X |
| 3,963,252 | 6/1976 | Carlson | 280/11.22 |
| 3,993,318 | 11/1976 | Rothmayer . | |
| 4,072,317 | 2/1978 | Pommerening | 280/11.23 |
| 4,107,856 | 8/1978 | Bourque | 36/50.1 X |
| 4,351,537 | 9/1982 | Seidel | 36/115 X |
| 4,391,049 | 7/1983 | Parisotto | 36/54 X |
| 4,418,929 | 12/1983 | Gray | 280/11.23 |
| 4,562,651 | 1/1986 | Frederick et al. | 36/102 |
| 4,708,352 | 11/1987 | Vullierme | 280/11.26 |
| 4,817,304 | 4/1989 | Parker et al. | 36/114 |
| 4,844,491 | 7/1989 | Wheelwright | 280/11.2 |
| 4,943,075 | 7/1990 | Gates | 280/842 |
| 5,068,984 | 12/1991 | Kaufman et al. | 36/120 X |
| 5,086,576 | 2/1992 | Lamson | 36/131 |
| 5,092,614 | 3/1992 | Malewicz | 280/11.22 |
| 5,142,798 | 9/1992 | Kaufman et al. | 36/120 X |
| 5,171,033 | 12/1992 | Olson et al. | 36/115 X |

FOREIGN PATENT DOCUMENTS

| | | | |
|---|---|---|---|
| 0152017 | 8/1985 | European Pat. Off. . | |
| 0167765 | 1/1986 | European Pat. Off. . | |
| 0229267 | 7/1987 | European Pat. Off. . | |
| 0273891 | 7/1988 | European Pat. Off. . | |
| 0295824 | 12/1988 | European Pat. Off. . | |
| 0334783 | 9/1989 | European Pat. Off. . | |
| 2745040 | 4/1979 | Fed. Rep. of Germany . | |
| 3442292 | 5/1986 | Fed. Rep. of Germany . | |
| 9017320 | 3/1991 | Fed. Rep. of Germany . | |
| 4040985 | 6/1992 | Fed. Rep. of Germany . | |
| 1496852 | 10/1967 | France . | |
| 8504029 | 9/1985 | PCT Int'l Appl. | 36/132 |
| WO8903712 | 5/1989 | PCT Int'l Appl. . | |
| 9000425 | 5/1989 | PCT Int'l Appl. . | |
| 19062 | of 1890 | United Kingdom | 280/11.3 |
| 2157182 | 10/1985 | United Kingdom . | |
| 2239780 | 7/1991 | United Kingdom . | |

*Primary Examiner*—Paul T. Sewell
*Assistant Examiner*—BethAnne Cicconi
*Attorney, Agent, or Firm*—Merchant, Gould, Smith, Edell, Wetter & Schmidt

[57] ABSTRACT

A skating vehicle has a frame with a blade or rollers mounted thereon and a boot for mounting a detachable shoe in a locked position thereon. The boot includes a rigid wall which encircles the sole of the shoe cradled within, and a rearward projection in the toe portion which enters a slot in the shoe sole when the shoe is inserted and moved forward, locking the shoe in the boot. A rear semirigid cuff is lined with a padding whose lower edge is proximate with and communicates with the upper edge of the shoe during skating. The cuff is closed with an adjustable latch which comprises the single device required to mount and dismount the shoe. The multi-use shoe includes a semirigid outer heel attached to the sole extremity and a semirigid outer tongue overlying the shoe upper. A strap attachment has one portion attached to the medial side of the upper and communicating with the outer heel to encircle the shoe heel, and a second portion passing from the rear portion of the sole on the medial side over the upper beneath the outer tongue. The free ends of the strap portions are adjustably attached to mount the shoe on the wearer's foot such as with hook and loop attachment material. The cuff collapses downwardly to reduce the skate size for portability.

11 Claims, 8 Drawing Sheets

SKATE WITH DETACHABLE SHOE

BACKGROUND OF THE INVENTION

The present invention relates to skates and more particularly to skates with detachable shoes.

Skates designed for attachment to conventional shoes are shown in the prior art. As an example, U.S. Pat. No. 25,295 of Wheeler discloses an ice skate having an extendable heelpiece for permitting the insertion of a shoe into a webbed structure with adjustable straps.

U.S. Pat. No. 1,835,446 of Tracy shows an in-line roller skate with a toe strap and an ankle strap to hold a shoe on the flat footplate.

U.S. Pat. No. 3,228,707 of Davis et al. shows a roller skate having a bifurcated pliable, e.g. leather member with an elastic insert. The member overlies the shoe from toe to ankle, is attached at the front and rear of the skate and has an adjustable strap for tightening the pliable member about the shoe.

U.S. Pat. No. 3,829,111 of Nicholls describes an in-line roller skate having plastic foot straps and a heel enclosure, each of which is laced over the shoe.

U.S. Pat. No. 3,963,252 of Carlson discloses an in-line roller skate having a stiff non-rotatable laceable heel enclosure and a laced plastic foot covering. The heel enclosure and foot covering are slidable for accommodating different shoe sizes and to ease mounting of the shoe therein.

U.S. Pat. No. 3,993,318 of Rothmayer and U.S. Pat. No. 2,168,820 of Edstrom disclose skates having a buckled toe strap and a non-pivotable heel member having several straps which are buckled over the inserted shoe.

U.S. Pat. No. 4,072,317 of Pommerening shows an in-line roller skate in which the ankle bracing support includes a strap about the lower ankle and a pivotable cradle which extends above the ankle to be strapped to the wearer's leg. A laced strap extends over the shoe behind the toe portion.

U.S. Pat. No. 4,418,929 of Gray shows an in-line skate in which a shoe is mounted and held on a pair of support plates by a toe strap and a middle foot strap, both attached by self-adhering means. A leg case encloses the lower leg, i.e. ankle.

U.S. Pat. No. 4,708,352 of Vullierme discloses a roller skate with a toe plate and a heel plate which are telescopically extendable relative to each other. An enclosure on the toe plate substantially covers the foot up to the ankle, and the heel plate has a heel retainer with an adjustably buckled strap which passes over the user's foot and over a tongue on the toe enclosure.

U.S. Pat. No. 4,884,491 of Wheelwright discloses a three wheeled skate in which a shoe is attached to the skate. A toe shroud covers the toe of the shoe and presses downward thereon. In addition, the shoe heel fits in a slidable heel cup and a pivotable ankle brace is strapped about the user's ankle above the shoe.

Each of the above indicated prior art disclosures requires a relatively stiff shoe with relatively inflexible sole, in order to operate with sufficient long-term comfort. The soft padded sport shoes which have recently gained extreme popularity are not readily accommodated by the prior skates because (a) retaining forces are concentrated on small areas of the user's foot, causing discomfort, or (b) the shoe is free to twist and bend within the shoe retainer, leading to less control in operation and an accompanying loss of safety. In addition, mounting of the shoe in the skate requires multiple operations to achieve the desired alignment and tension on the shoe, if such is possible. None of the above listed prior art skates has met with significant commercial success.

U.S. Pat. No. 4,943,075 discloses wheeled skate-skis in which a pair of wraparound bindings are draped around the skater's sport shoes and attached to the skate with "Velcro" fasteners. However, it is known in the art that the retaining strength of such fasteners is insufficient to accommodate the high forces often generated in skating movements, particularly when the forces are exerted in a direction coinciding with the direction of movement which separates the "Velcro" components.

PCT Publication No. WO 89/03712 of Murga discloses a skate for use with a sport shoe. The shoe is retained on the skate base by a toe strap and a heel enclosure. Extending upwardly from the heel enclosure and spaced from the shoe is a pivotable leg support which is attached about the user's leg. The skating forces are concentrated in a narrow band over the skater's foot and in a band on the leg, rather than being more widely distributed over the surface of the foot.

The need remains in the art for a commuter skate having a detachable shoe, the combination of which is stable, comfortable and safe, and wherein the shoe per se comprises a useful and aesthetically pleasing sport shoe. There is a further need for such a combination in which the shoe and skate are joined and separated by the use of a simply operated buckle. There is a still further need for such a sport shoe which is easily attached to the wearer's foot with minimal effort yet is firmly retained on the foot. In addition, the need exists for a skate-shoe combination wherein the toe of the shoe is held rigidly in the skate.

The need further exists for a comfortable and safe commuter skate which collapses to a reduced size for e.g. carrying in a portable pack or storage in a locker.

SUMMARY OF THE INVENTION

The invention is a skating apparatus comprising a frame with a hard shell and skate surface contact element(s), and a multipurpose shoe which slips into, and is cradled within the shell. The shoe is configured to be worn either with the frame or apart from the skating frame as a separate street shoe or sport shoe, for example. The shell and shoe have interacting features which (a) guide the shoe into a specific locking position within the shell, (b) firmly lock the shoe sole against upward toe movement and lateral sole movement within the shell, yet permit the wearer's ankles to comfortably pivot forward against a resistance, (c) provide the desired comfort for extended skating, (d) enable rapid mounting and dismounting, and (e) provide an attractive shoe which is comfortable for extended wear for school, work and sporting purposes. The skate is lightweight and furthermore, the pivotable cuff assembly may be rotated downwardly to a collapsed position for portability or storage in limited space.

The shoe is locked to the skate at a given toe position to enhance control during skating movement. As a result, shoes of differing sizes, over a limited range, may be used with the same skate. Thus, shoes within a four half-size (or two full size) range may be used while maintaining high performance.

In one configuration, the invention is an in-line skate particularly useful to students for commuting to school, work, or other informal events including participation in other sports. The shoe-skate combination of the invention obviates the need for the skater to carry additional shoes for off-skate wear. In a preferred configuration, the skating shoe is a padded sport type shoe with an elastomeric sole.

The means for effectively guiding and locking the shoe within the skate includes several features. A slot in the front periphery of the shoe sole interacts with a matching projection in the concave interior of the toe of the shell. The edge of the sole is cradled within an enclosing wall of the boot, but is not necessarily in circumferential contact with the wall. A detent projecting upwardly from the boot plate fits into an aperture in the shoe sole to position the shoe in the same longitudinal position each time the shoe is inserted. A slanted front wall of the aperture interacts with the sloped forward edge of the detent to force the shoe sole forwardly as it is inserted into the boot. An additional feature which may be incorporated for seating the sole comprises one or more vertical ramps in the heel portion of the boot. The ramp(s) force the inserted shoe forwardly to a position where the detent engages the aperture for final sole seating. Thus, the forces retaining the forward part of the shoe on the skate are located in the sole of the shoe rather than concentrated in a limited area atop the user's foot. Lateral skating forces generated between skate and shoe are transmitted from the toe of the sole through the sole to the entire shoe.

A pivotable semirigid cuff extends upwardly from an elevated heel enclosure, and is lined with padding which adjoins or is somewhat spaced from the upper edge of the shoe. Thus, when a strap across the front of the cuff is closed, the padding prevents any significant upward movement of the shoe in the boot, locking the shoe in place. The entire cuff, however, may pivot forward to accommodate the forward pivoting of the skater's leg in natural skating motion. Use of a variably adjustable latch permits adjustment of the resistance to forward pivoting of the skater's leg.

When the cuff is closed, as by a strap and latch, the front portion of the cuff interacts downwardly with a semirigid or rigid outer tongue of the shoe. Thus, stresses between the boot and the upper of the shoe are distributed by the tongue over an extended area of the foot. The outer tongue may be formed of a low friction material to reduce friction between the tongue and cuff assembly during skating movements.

The hard shell of the skate boot also includes a cowl or toe retainer which overlies the outside toe area to provide a limit to upward toe movement during skating, and for protection of the user's toes and foot in the event of a spill. The size of the toe retainer is limited for easy insertion of the shoe in the boot, and need not extend completely across the foot.

The multi-purpose shoe includes a semirigid or rigid outer heel enclosure which may be connected to the shoe only at its lower extremity. During insertion of the shoe into the boot, the vertical ramp(s) in the boot heel interact with the rigid shoe heel to force it forward, as already described. The heel enclosure also comprises means for comfortably and supportively attaching the shoe to the skater's foot, and provides protection against heel injury when the shoe is used in other sports.

The configuration of the boot and shoe ensure interaction to achieve ease of mounting and dismounting, locking of the shoe in a stationary position for high performance skating, comfortable commuter, recreational or competitive skating, a high safety factor and an aesthetically pleasing boot, shoe and combination thereof. the lightweight, compactible skate is highly portable. The detached shoe is itself attractive and useful for informal wear and for sporting activities, obviating the need to carry a separate pair of shoes when commuting.

BRIEF DESCRIPTION OF THE DRAWINGS

In the drawings,

FIG. 12 is a graph depicting internal rib angles in an embodiment of the invention.

DESCRIPTION OF THE ILLUSTRATED EMBODIMENTS

Figure 1:
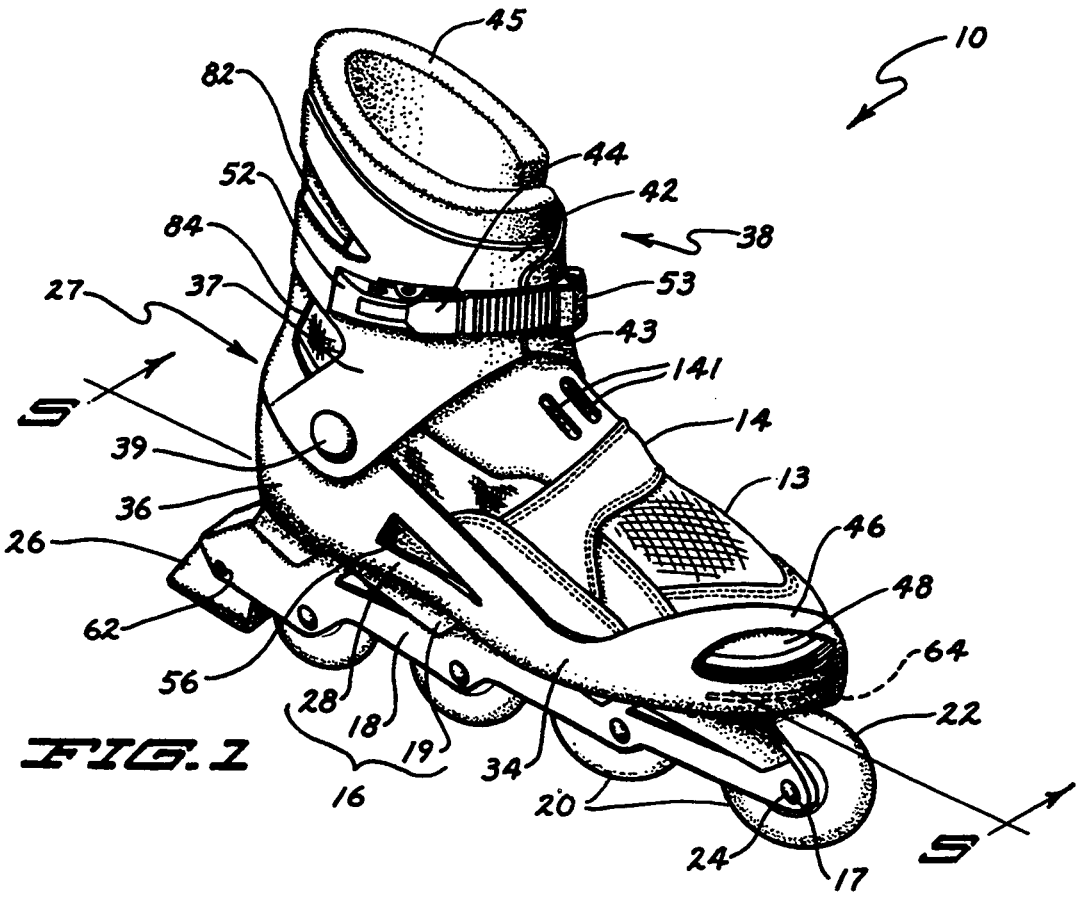
FIG. 1 is a lateral perspective view of the combination of a skate and detachable shoe mounted therein, in accordance with the invention.

Referring to the drawings, wherein like numerals indicate like elements, a skating apparatus 10 is illustrated in FIG. 1 and will be described in combination with FIGS. 2 through 4. The apparatus 10 includes an in-line skate 12 (shown as a right footed skate) with a detachable shoe 14 inserted and locked therein in accordance with the invention, is shown in FIG. 1. The shoe 14 is depicted in the figures as a sport shoe with a generally soft upper 13. The skate 12 is shown as including a frame 16 which is comprised of a boot 28, a blade 18 and connecting structure to be further described in combination with additional figures. Surface contact means are mounted on blade 18 and may be ground engaging rollers 20 for roller skating or a narrow elongate linear element useful for ice skating and well known in the art. The blade 18 is shown with two parallel, spaced apart blade members 48, 49. The surface contact means is more particularly shown in FIG. 1 as a plurality of in-line wheels 22 mounted on transverse axles 24 passing through mounting apertures 17 in blade members 48, 49. The skate 12 is shown with a rear mounted stop or brake pad 26 operated by pivoting the heel 27 of the skate 12 downward to engage the pad 26 with the skating surface 60 (FIG. 3). The stop 26 is shown as mounted by a screw fastener 62 to the blade 18 (FIG. 1).

A boot or shell 28 is mounted to the blade 18 by intervening structure including a circumferential wall 19 (FIG. 3) to provide a nest or cradle into which the detachable shoe 14 is downwardly and forwardly inserted and affixed for skating. The frame 16 including boot 28, blade 18 and intervening structure may be formed as a single rigid unit, as by molding of a hard plastic material, e.g. nylon. The boot 28 has a shoe bed 32 comprising the top surface of support structure 58 (See FIG. 2). The shoe bed 32 is covered with a shoe bed liner 31 (FIGS. 1 and 5) and a shoe-encircling peripheral wall 34 which extends upwardly from the lateral wall 19 to generally cradle and girdle the sole 15, FIG. 5, of shoe 14. The peripheral wall 34 does not generally extend completely over the shoe 14, but is generally open for downward insertion of the shoe thereinto. The rear portion of the shoe girdling wall 34 extends further upwardly to form a generally rigid heel enclosure 36.

The means for retaining the shoe 14 in the proper position in the boot 28 mat include a front elongate rib or projection 64 coincident with the sole 15 of the mounted shoe, and a corresponding elongate slot 66 in the shoe sole. See FIGS. 5 and 8–10. The projection 64 and slot 66 are arcuate in a generally horizontal plane, and forces directed forwardly as well as to the sides are accommodated without release of the shoe 14.

A padded cuff assembly 38 includes a semirigid cuff 37 and latch means 44. The cuff 37 is attached by pivot means 39 to each side of the heel enclosure 36 to pivot about a transverse axis 40 (FIG. 2). The lower rear edge 35 of cuff 37 rests on a circumferential ridge 33 in the heel enclosure 36 (See FIGS. 3 and 4) to limit the rearward pivoting of the cuff assembly 38 during skating operations to the position shown in FIG. 3. The cuff 37 is depicted as including forwardly projecting semi-rigid lateral flaps 42, 43 which are sufficiently flexible to permit bending inwardly and outwardly for insertion of the shoe into the skate, and removal therefrom. The cuff 37 is shown as being lined with a padding member 45. The padding member 45 is attached to the cuff 37 by e.g. cementing. The lower edge 47 (See FIG. 5) of padding 45 is in some regions, roughly proximate the upper edge 50 of the shoe 14, so that upward movement of the user's ankles and the rear portion of the shoe is limited to prevent disengagement of the shoe 14 from its locked position in the boot 28. The cuff assembly 38 is attached to a skater's lower leg by overlapping the cuff flaps 42, 43 and locking adjustable latch 44 at the desired position which achieves the optimum resistance to forward pivoting of the skater's leg relative to the skate, and prevents disengagement of shoe 14 from the shell, i.e. boot 28.

A partial cowl or toe retainer 46 is shown as an extension of the semirigid shoe-encircling wall 34 and overcovers the outer toe portion of the skater's foot, not shown, within shoe 14. The toe retainer 46 prevents the toe 48 of the shoe 14 from inadvertently disengaging outwardly from the boot 28 due to extremely high tensile forces, as may occur in an accident, and also protects the wearer's toes from possible abrasion resulting from contact with the skating surface in such instances.

The latch 44 may be any easily operated adjustable connecting/disconnecting means which firmly joins the two lateral cuff flaps 42, 43. The latch 44 has right and left portions 52, 53 attached to the right and left flaps 42, 43 respectively of the cuff 37, and may include intervening strap portions. An exemplary latch 44 is shown in the figures as a ratchet buckle. Such ratchet buckles are typically used for adjustable mounting of alpine ski boots, well known in the art.

The terms "rigid" and "semirigid" refer to the bending or flexural properties of the material of construction as well as the thickness dimensions of the component which contribute to its rigidity and strength. The frame 16, including the boot 28, lateral wall 19, internal framework shown in further figures, and blade 18, together with features to be further defined, are designed to maintain alignment and rigidity despite high forces developed during skating movements. In accordance with a preferred embodiment of the invention, the rigid frame 16, including blade 18, boot 28 and intervening structure may be integrally formed of a tough plastic material such as nylon having a flexural modulus of at least about 50 Kpsi and preferably at least 100 Kpsi, as measured at room temperature and 50% relative humidity (RH). An exemplary material useful for this application is a nylon material sold by Dupont with the designation Zytel ST801, and having a flexural modulus of 125 Kpsi at 23 degrees C. and 50% RH. Other materials may be used which have the requisite long term strength/flexure characteristics, appearance, cost and ease of fabrication. The preferred mode of manufacture is injection molding of the frame in one piece, with subsequent addition of the surface contact means 20, cuff assembly 38, shoe bed liner 31 and stop member 26.

The thickness of the frame and boot members may typically be on the order of about 1–5 mm, depending on the anticipated local stresses and the physical properties of the material(s) used. A minimum of material is used, resulting in a rigid, high strength but light weight skate. Apertures such as slots 56, 58 may be formed in the frame 16 for e.g. weight reduction and/or aesthetics.

Means for guiding the shoe into the boot and locking it into the boot are illustrated in FIGS. 2 through 11.

Figure 2:
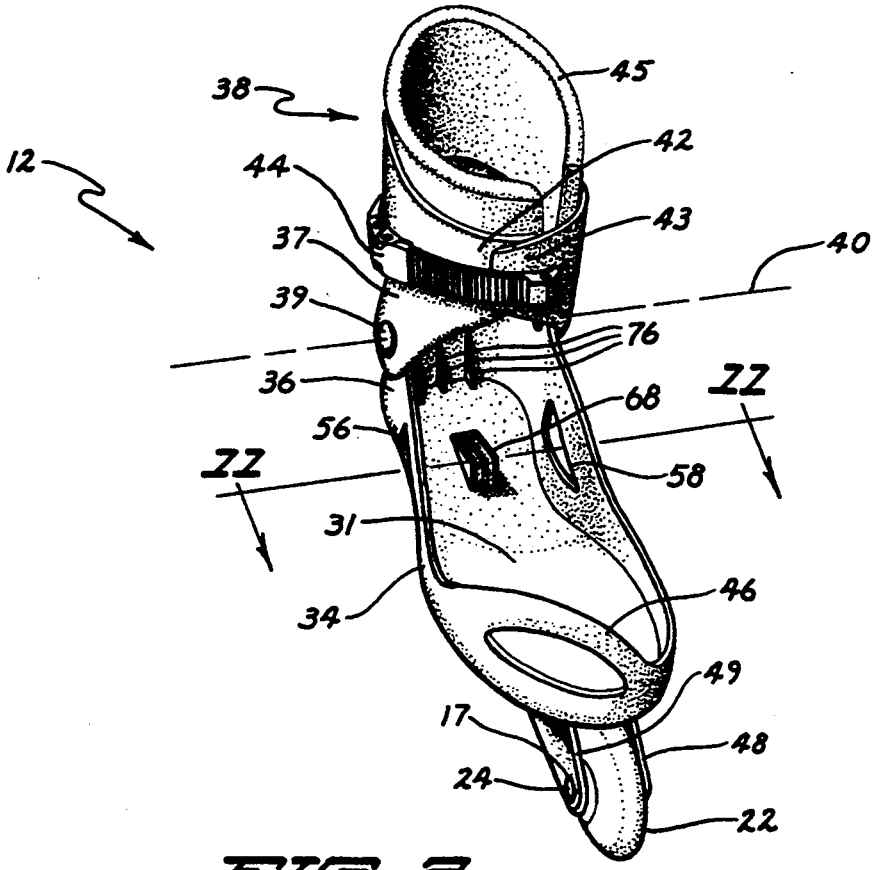
FIG. 2 is a frontal perspective view of the skate of the invention.
Figure 3:
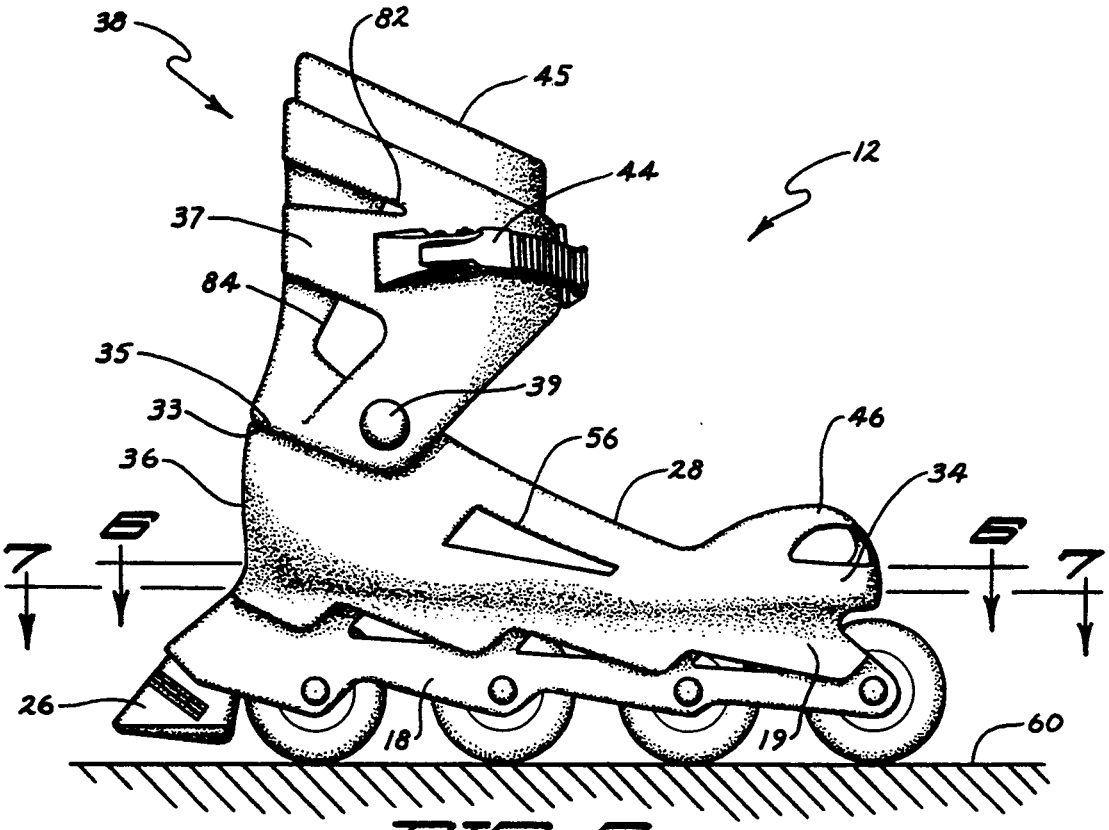
FIG. 3 is a right side elevational view of a right footed skate of the invention in the normal skating configuration, minus the detachable shoe.
Figure 5:
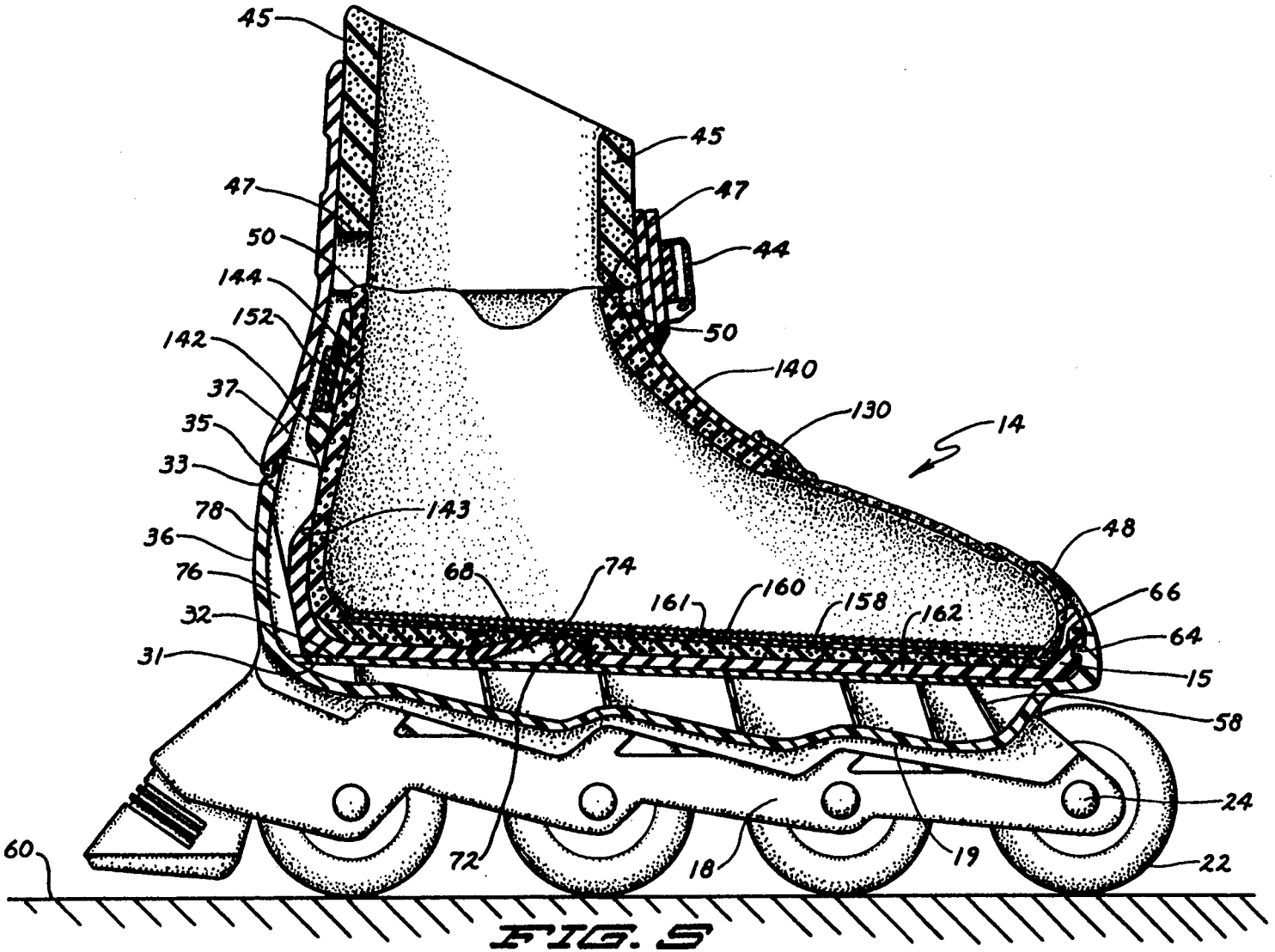
FIG. 5 is a toe-to-heel vertical cross-sectional view of the skate and attached shoe along line 5—5 in FIG. 1.
Figure 6:
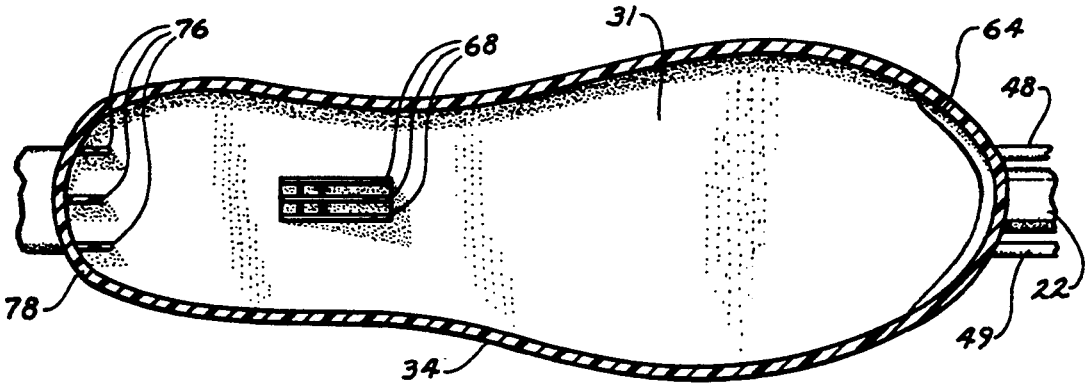
FIG. 6 is a cross-sectional plan view of the skate as taken along line 6—6 in FIG. 3.

As shown in FIG. 2, a detent 68 projects upwardly through the liner 31 to engage an aperture 70 in the sole 15 of shoe 14 (See FIG. 5). The detent 68 may be formed of several upright planar members, and has a planar front 72 which is angled upward toward the rear of the boot. The corresponding aperture 70 has a similarly angled front wall 74. The angles from the vertical of front 72 and wall 74 may typically be about 5–35 degrees and preferably up to about 20 degrees. Thus as the shoe 14 is inserted downwardly, the detent 68 engages the aperture 70 and forces the sole 15 forward in the boot.

Also shown in FIGS. 2 and 5–7 is a ramp means 76 in the heel portion 78 of the boot 28. The ramp means 76 is shown as three narrow ramps or ribs which engage the heel portion of shoe sole 15 to force the sole forward to a position where the detent 68 engages the aperture 70 for subsequent additional forward movement of the sole.

The shoe bed 32 may be sized with sufficient space to accommodate a range of shoe sizes. For example, shoe sizes over a range of e.g. four half-sizes may be used with the same skate 12. The separation between the front slot 66 and the detent aperture 70 is then the same, regardless of shoe size within the given range.

Figure 4:
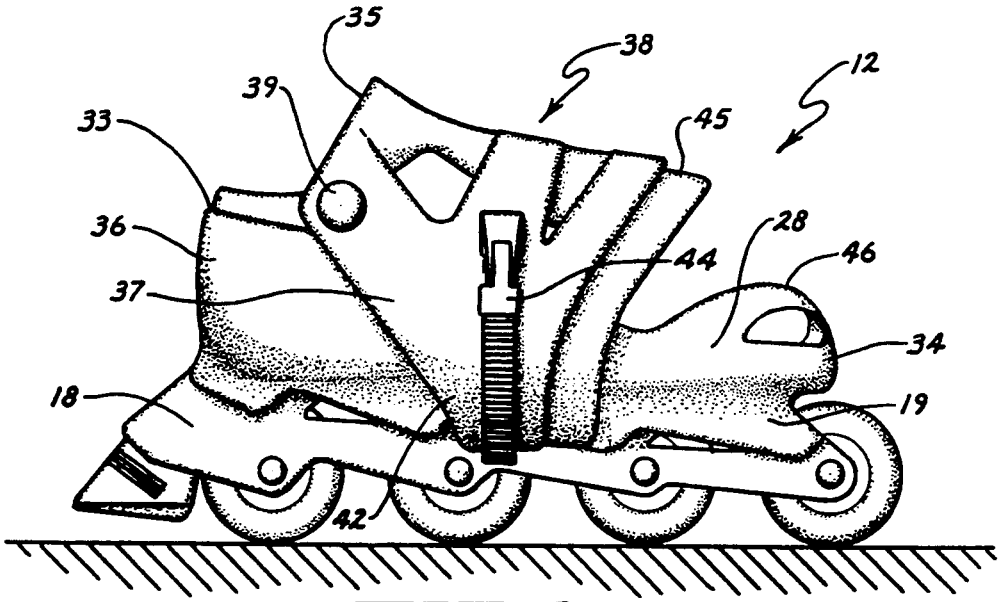
FIG. 4 is a right side elevational view of the right footed skate, minus the shoe, in a folded transportable configuration.

Turning now to a particular feature illustrated in FIGS. 3 and 4, the skate 12 is shown after removal of the shoe 14, to be collapsible to a reduced size for enhanced portability and storage. Thus, the cuff assembly 38 may be forwardly and downwardly pivoted from its normal skating configuration (FIG. 3) to a carrying/storage configuration of FIG. 4. The cuff is rotated forwardly through an angle 80 of at least 70 degrees, and may be rotated up to 100 degrees or more, depending on the material and construction of the padded cuff assembly 38.

The cuff 37 is formed of a material which permits the lateral flaps 42, 43 to be bent outwardly during attachment and detachment of the shoe to the skate, and for collapsing the cuff assembly 38 to a storage position. While the cuff rigidity should be less than the rigidity of the skate frame, its flexural modulus must not be so low that inadequate leg support occurs. The cuff 37 is typically formed of a material having a flexural modulus lower than that used for the frame to permit flexing of the flaps 42. Polyurethane or other materials which withstand repeated flexure may be used. The cuff 37 may include apertures such as aperture 82, 84 for weight reduction and aesthetic considerations.

Figure 7:
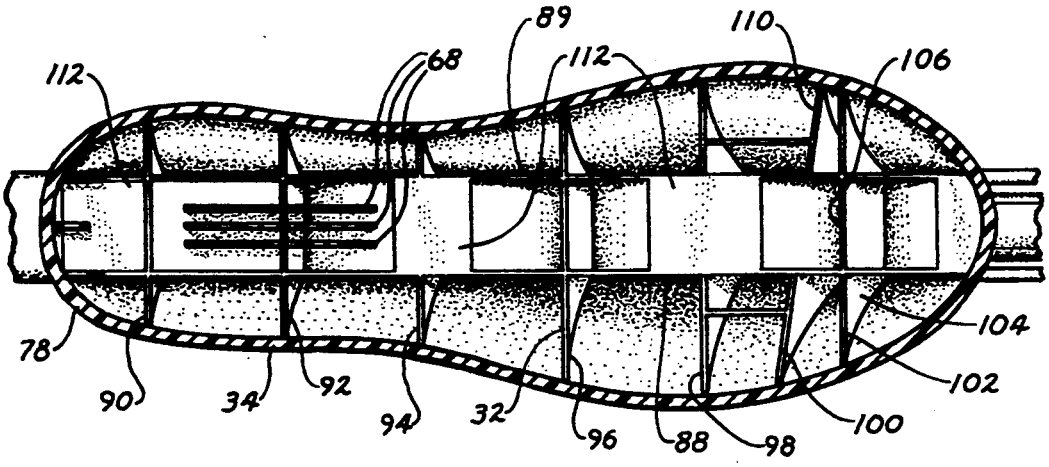
FIG. 7 is a cross-sectional plan view of the skate as taken along line 7—7 in FIG. 3.
Figure 8:
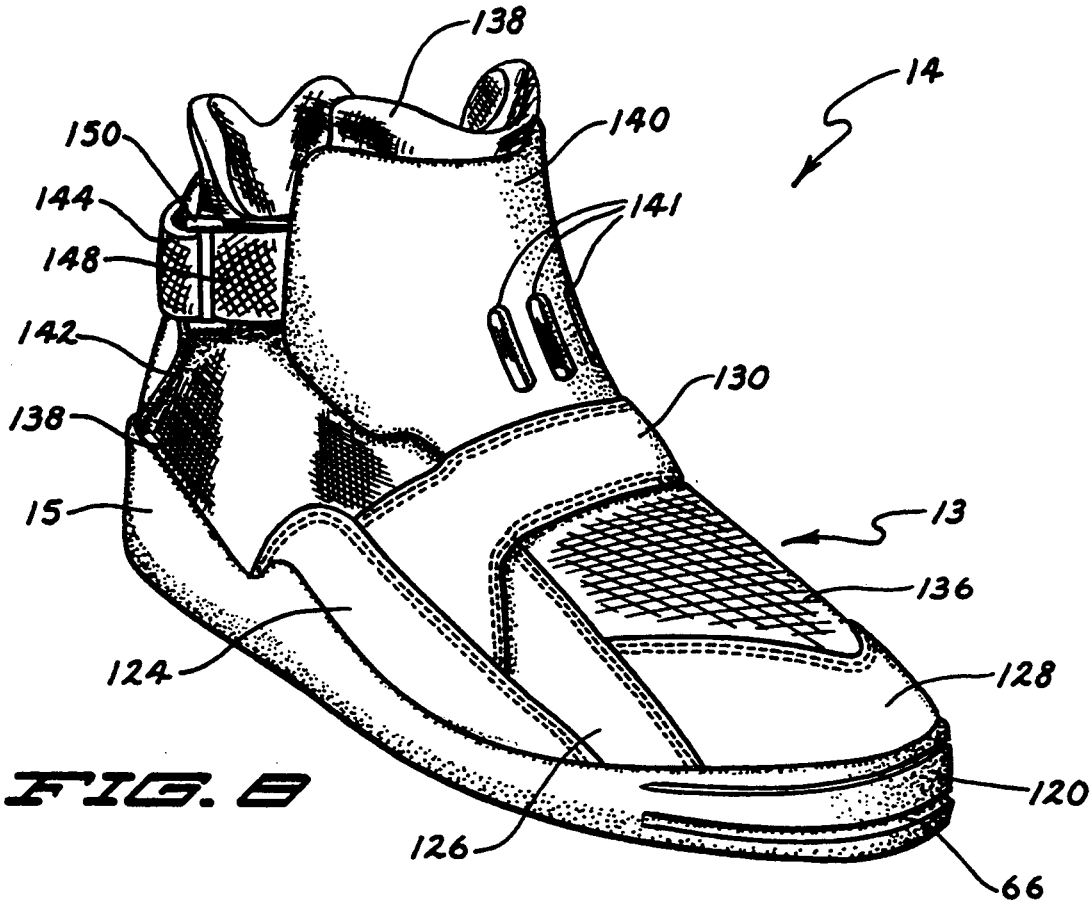
FIG. 8 is an upper right front quarter perspective view of a right-footed detachable shoe in accordance with the invention.
Figure 9:
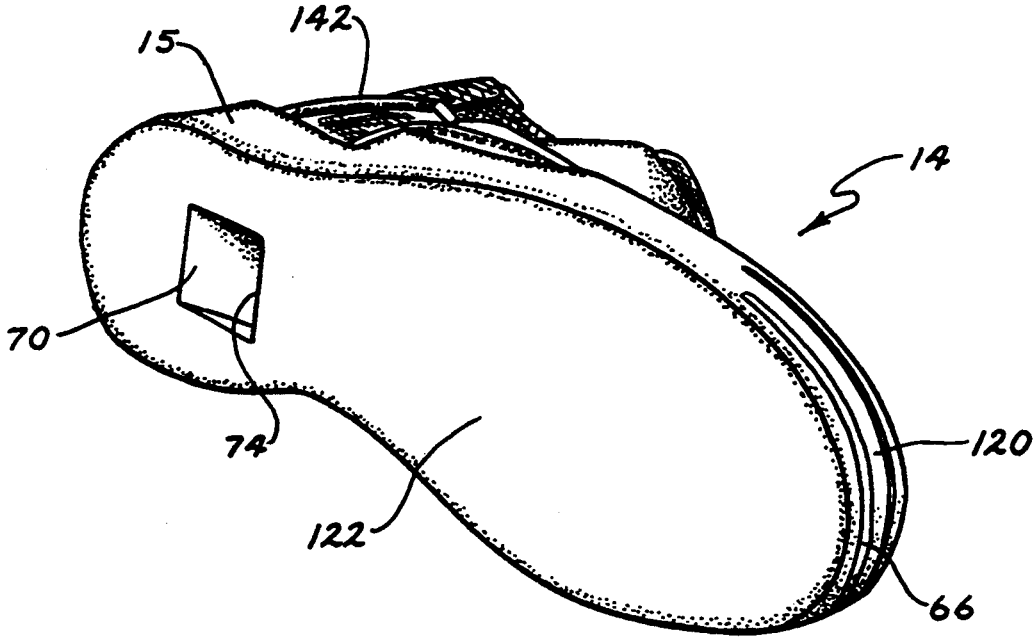
FIG. 9 is a lower right front quarter perspective view of a right-footed detachable shoe in accordance with the invention.
Figure 11:
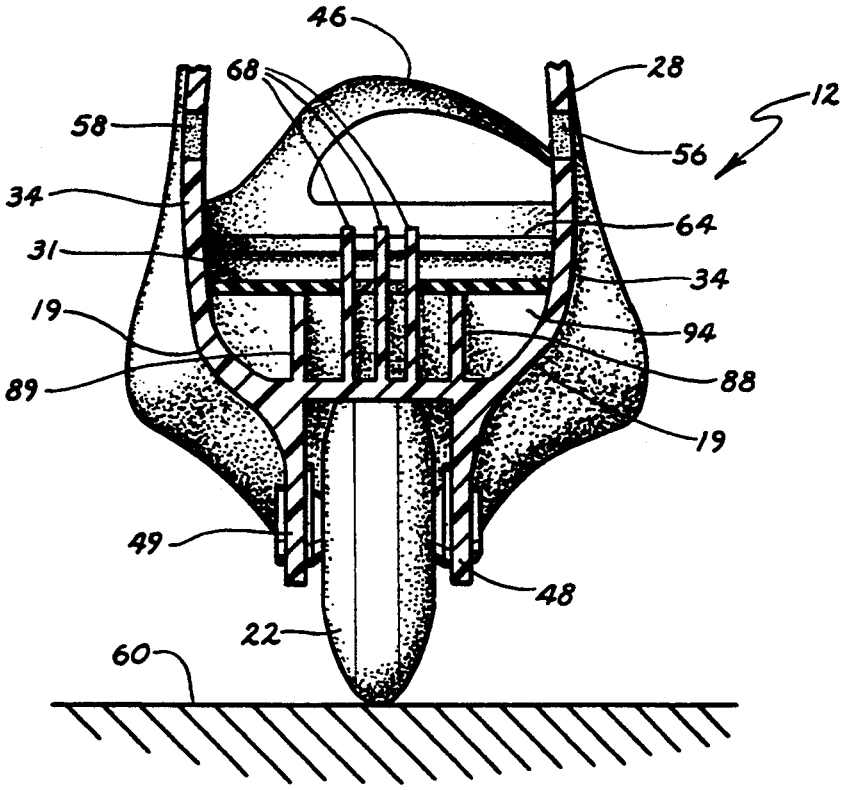
FIG. 11 is a vertical cross-sectional view of the skate of the invention as taken along line 11—11 in FIG. 2.
Figure 18:
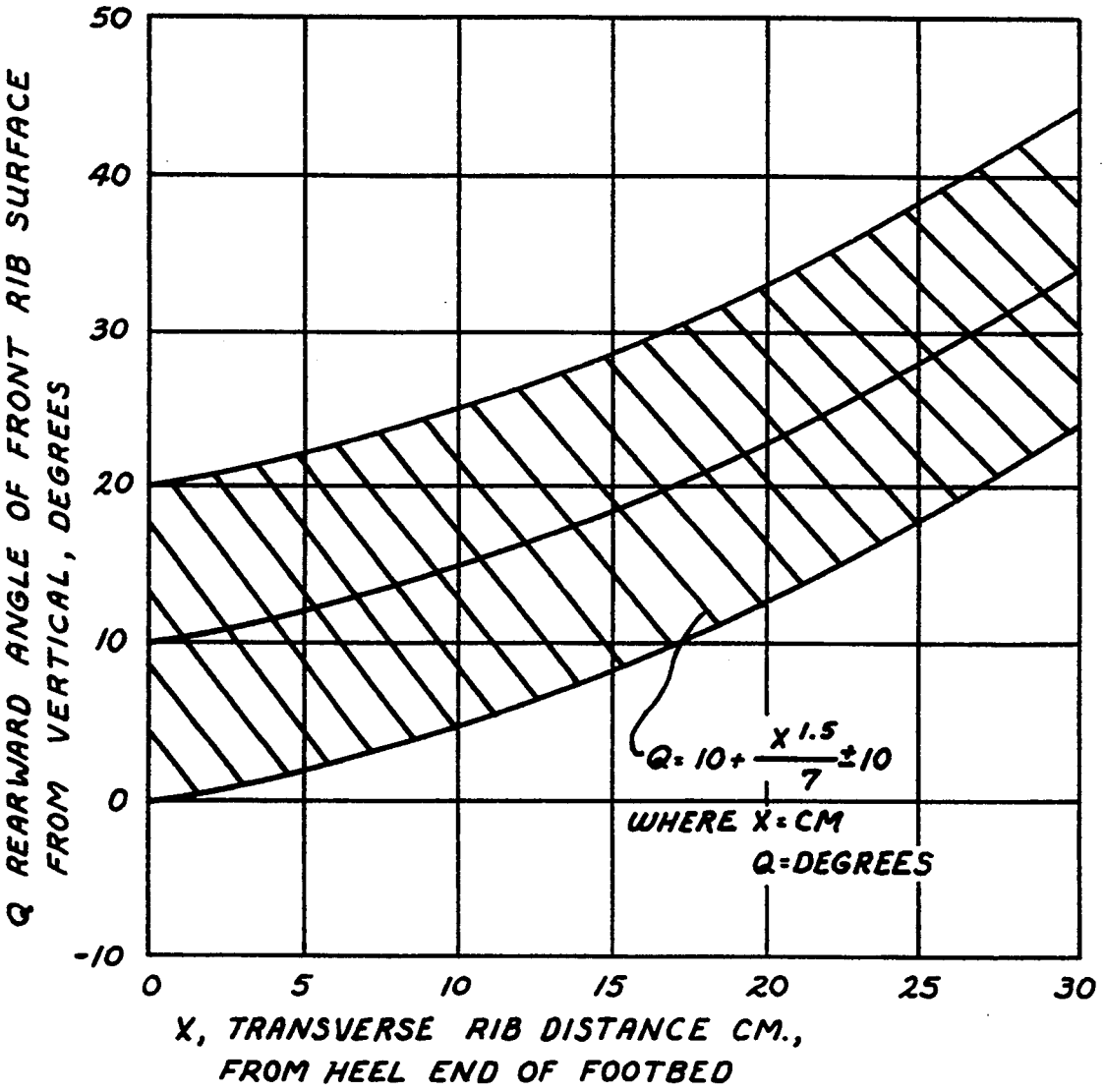

As shown in FIGS. 5, 7 and 11, the frame structure provides high strength and rigidity to the skate with a minimum of material. The bifurcated blade 18 comprises left and right parallel blade members 49, 48 which are spaced apart for rotatable attachment of the ground contact wheels 22. The blade members include upward extensions thereof, designated 89, 88 in FIG. 11, which have upper surfaces designated as a shoe bed 32. As shown in FIG. 7, transverse ribs 90, 92, 94, 96, 98, 100, and 102 are also part of the shoe bed 32 and provide reinforcement structure to support the shoe. The generally transverse ribs are integrally formed in the spaces between blade member extensions 88, 89 and corresponding lateral walls 19. The ribs may be configured to be parallel to the highest compressive forces, i.e. vertical. In a preferred embodiment, however, the ribs are sloped. Each of the ribs 90–102 has a front face and a rear face. Thus, rib 102 is shown with front face or surface 104 and rear face or surface 106. In this embodiment, the angles of the rib faces are important to manufacture of the frame structure as a single unit. In this method, the frame is formed by injection molding on a last. The shoe bed 32 is removed from the last by a separating action beginning at the rear of the shoe bed. As the line of separation moved forward toward the toe end, the angle of separation is tilted toward the rear. Rapid and precise separation occurs when the front rib surfaces of the ribs are at a rearward angle Q from the vertical such that:

$$Q=10+(X^{15})/7+/-10,$$

where Q is the rearward angle of the front face of the rib, in degrees from the vertical, and X is the distance in cm. of the upper surface of the rib from the heel end of the foot bed.

The rear faces of the ribs may be similarly angled, but preferably are configured to have an angle Q of 1–10 degrees less than the front faces.

The relationship between Q and X for the front faces of the transverse ribs 90–102 is illustrated in FIG. 12.

As shown in FIG. 7, the upper edge 110 of transverse rib 100 is not parallel to the other transverse ribs. Use of the non-parallel rib 100 in the region where the ball of the skater's foot impinges results in added support and resistance to transverse bending forces acting on the skate. The result of the footbed substructure as described above is a very lightweight skate which has high rigidity, high strength and consistent blade alignment.

As further shown in FIG. 7, a continuous transverse web 112 spans the space between the blade members 48, 49 from the toe end to the heel end. The web is variably oriented between the blade members 48, 49 to provide wheel wells therebetween with adequate clearance for wheel rotation.

Figure 10:
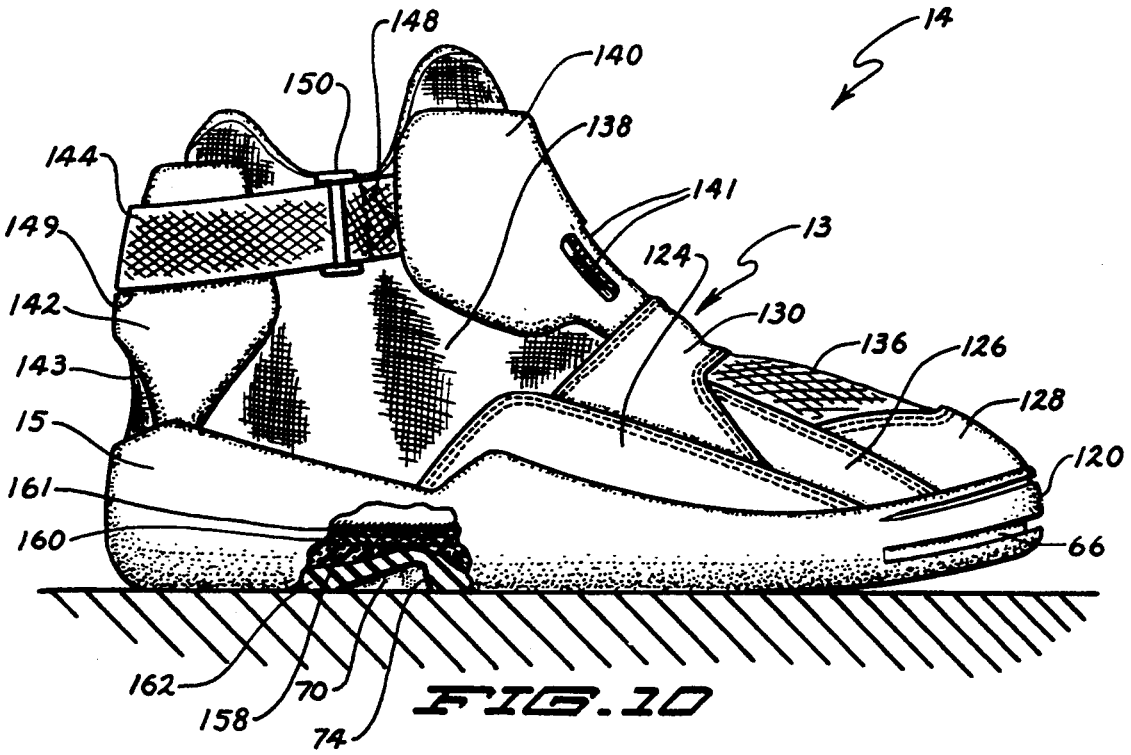
FIG. 10 is an elevational, partially cutaway view of the lateral side of a detachable shoe in accordance with the invention.

The detachable shoe 14 is depicted in FIGS. 1, 5, and 8–10 as a sport/casual shoe having a generally soft upper 13 and a relatively flexible sole 15. The upper 13 is shown as being formed of panels of differing materials as desired, and may include both padded and unpadded fabrics, leather, plastic, etc. The illustrated version of the detachable shoe has suede leather panels 124, 126, 128, 130, 132 and 134 which are generally sewn together. The figures show a mesh panel 136, and an internal boot 138 of soft padded fabric. A rigid or semirigid external tongue 140 is attached to panel 130 and may flex forwardly for insertion of the wearer's foot. The tongue 140 encases the front of the wearer's ankle and distributes downwardly directed forces over the ankle. Thus, the shoe 14 is locked into the skate 12 by overlapping the cuff flaps 42 and 43 (FIGS. 1 and 2) and connecting the latch 44. The flaps 42 and 43 overlie the tongue 140 to absorb upwardly directed forces from the skater's foot. The tongue 140 is preferably formed of a low-friction plastic material such as nylon. The flexibility of tongue 140 may be controlled by varying the material of construction, the tongue thickness, or by the use of slot(s) or other aperture(s) 141 as depicted in FIG. 10.

Figure 13:
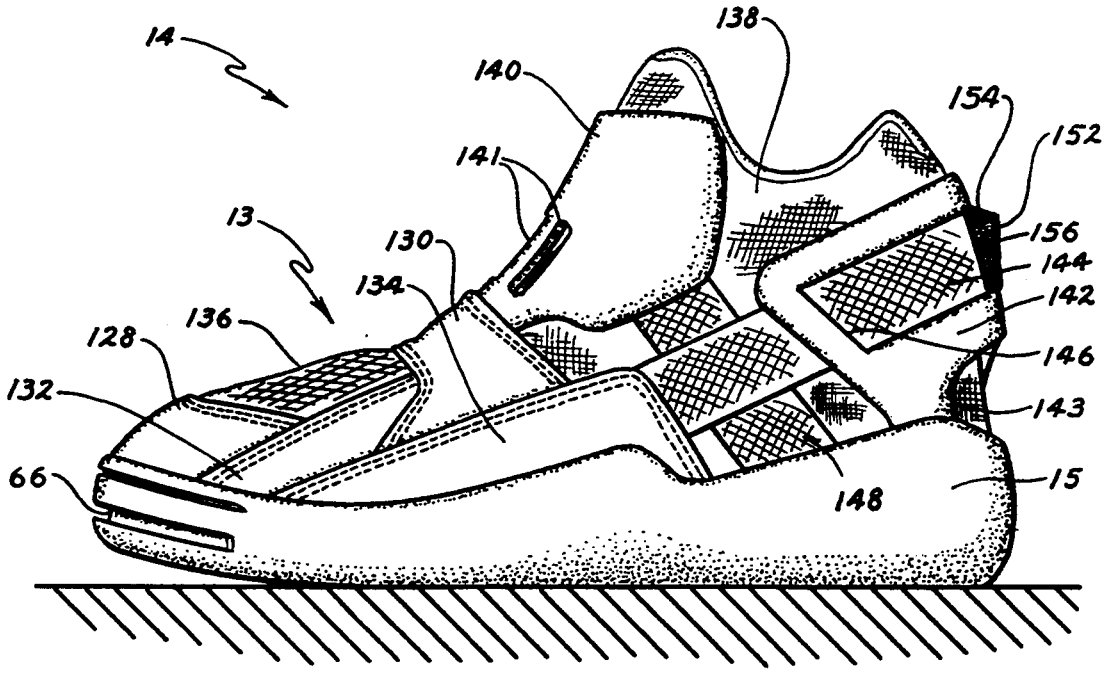
FIG. 13 is an elevational view of the medial side of a detachable shoe in accordance with the invention.

A rigid or semirigid external heel wrap 142 extends upwardly from the sole 15 to surround the rear portion of the skater's upper heel. The heel wrap 142 may be formed of a plastic material such as nylon or a relatively stiff elastomer. The heel wrap 142 is attached to the sole 15, and may include an opening 143 in the rear. The heel wrap 142 may include means for restraining a strap 144, shown as a slot 146 in FIG. 13 for guiding the strap. In addition, as shown in FIGS. 5 and 10, the heel wrap 142 has a strap retaining recess 149 which preferably is sufficiently deep to accommodate two overlapped straps, each with a hook-and-loop panel (FIG. 13) mounted thereon (FIG. 13). The shoe is held firmly on the wearer's foot by the two straps 144 and 148, both attached to the shoe 14 on the medial side of the shoe (shown as the right side of a left shoe in FIG. 13). Strap 148 is attached to the sole 15 near or at the heel of the shoe, forward of the external heel wrap 142. Strap 148 passes over the ankle of the wearer, beneath the tongue 140. Strap 144 is joined to the rear portion of panel 134 for anchorage in the front portion of the shoe 14. Strap 144 extends backward through slot 146 to pass around the upper heel of the wearer atop the heel wrap 142. Now, looking at the other, i.e. lateral side of the shoe in FIGS. 8–10, strap 144 and 148 are adjustably joined by a connector 150. As shown in FIG. 13, the free end portion 152 of strap 144 has panels 154 and 156 of hook and loop materials (such as that known as Velcro) so that strap 144 is doubled back on itself to attach the hook panel to the loop panel, locking the shoe on the wearer's foot.

As already, described, the shoe sole 15 contains a circumferential slot 66 in the toe edge 120. The bottom 122 (FIG. 9) of the sole 15 also contains aperture 70 for interacting with detent 68. The aperture 70 lies behind the front portion of the sole 15, and preferably is in a central portion of the instep or heel area of the sole, precisely aligned with the detent 68. The sole 15 is shown as generally formed of an elastomeric material such as rubber and is circumferentially joined to the upper 13 of the shoe 14. The sole 15 shown in FIGS. 5 and 10 as having a midsole 158 which is a foam core joined, e.g. cemented, to an upper core cavity of outsole 162. Midsole 158 is also cemented to the circumferential bottom portion of upper 13. A lasting board 160 and foot bed 161 are shown mounted on the foam midsole. The foot bed 161 may be removable or non-removable as desired. The outsole 162 is typically formed of solid rubber. This outsole-midsole combination provides a level of comfort similar to popular sport and casual shoes.

The combination of skate with detachable shoe is useful for students and others who frequently commute to school, work or elsewhere. Thus, for example, a student may skate to (and from) school, removing and collapsing the skates, and storing them in a pack or locker while at school. The detachable shoes 14 may be comfortably worn to class sessions, in physical sports, and other non-skating activities, obviating the need to carry one or more extra pairs of shoes while skate-commuting. Shoes of varied styles and colors may be manufactured to provide for differences in personal tastes.

Reference herein to details of the illustrated embodiments is not intended to restrict the scope of the appended claims which themselves recite those features regarded as important to the invention.

What is claimed is:

1. In combination, a skate and a detachable shoe, said skate comprising:

a shoe cradle for nestably receiving said shoe, said shoe cradle including an upwardly extending portion girdling the sole of said shoe;

a frame joined to and extending downwardly from said shoe cradle; and a plurality of ground-engaging members mounted in said frame;

said detachable shoe comprising a sole and an upper;

and wherein said combination further includes means for engagement between said skate and said shoe, said means for engagement provided to secure said shoe in a fixed position in said shoe cradle for substantially preventing movement of said shoe therein along a predetermined line of travel and for substantially preventing the toe of said shoe from lifting upwardly during skating activity;

said means for engagement includes said shoe sole including at least one elongate slot in the forward periphery of said sole and generally coplanar therewith, and a corresponding elongate rib projecting rearwardly from the toe of said shoe cradle to matingly engage said elongate slot when said shoe is nestably received within said shoe cradle; and said means for engagement further includes a detent extending upwardly from said shoe cradle rearward of said toe and said shoe sole includes an aperture configured to receive said detent as said shoe is inserted into said cradle and wedge said shoe sole forwardly for engagement of said elongate rib with said elongate slot in said shoe sole.

2. The combination of claim 1, further comprising:

a semirigid heel protector overcovering said shoe heel and joined at its lower portion thereto;

a vertical wedging ramp in the heel portion of said cradle and joined thereto for engaging said heel protector of said shoe as said shoe is downwardly inserted into said shoe cradle to force said shoe forwardly to engage said detent; and a cuff assembly extending upwardly from the rear portion of said cradle and pivotably attached thereto in a transverse pivot axis, said cuff assembly configured to enclose the lower leg of a skater and having padding means lining said cuff assembly above said cradled shoe for engaging said shoe to limit upward movement thereof and provide shock resistance to a lower leg.

3. A multipurpose shoe, said shoe comprising:

a sole having a toe end, a heel end and portions therebetween, said toe end including a peripheral slot about a major portion of said toe end, said slot configured for engagement with an internal projection in a boot, said sole and said boot including interactive means for effecting said engagement;

an upper mountable on a wearer's foot, said upper having a toe end and a heel end;

means for securing said shoe to said wearer's foot;

a semirigid external tongue encasing the front portion of said upper about the wearer's ankle and having a forward end attached to said upper;

a semirigid external heel shield encircling said heel end of said upper and having a lower end joined to said shoe;

said means for securing said shoe to said wearer's foot comprises a first strap crossing the center of said upper under said tongue, and a second strap passing exterior said heel end and interacting with said heel shield, said first and second straps each having one end joined to said shoe and an unattached end, said unattached ends configured to be removably attached to each other.

4. A multipurpose shoe, said shoe comprising:

a sole having a toe end, a heel end and portions therebetween, said toe end including a peripheral slot about a major portion of said toe end, said slot configured for engagement with an internal projection in a boot, said sole and said boot including interactive means for effecting said engagement;

an upper mountable on a wearer's foot, said upper having a toe end and a heel end;

means for securing said shoe to said wearer's foot;

a semirigid external tongue encasing the front portion of said upper about the wearer's ankle and having a forward end attached to said upper;

a semirigid external heel shield encircling said heel end of said upper and having a lower end joined to said shoe; and said said upper comprises a soft padded material, and said sole comprises an elastomeric material.

5. A multipurpose shoe, said shoe comprising:

a sole having a toe end, a heel end and portions therebetween, said toe end including a peripheral slot about a major portion of said toe end, said slot configured for engagement with an internal projection in a boot, said sole and said boot including interactive means for effecting said engagement;

an upper mountable on a wearer's foot, said upper having a toe end and a heel end;

means for securing said shoe to said wearer's foot;

a semirigid external tongue encasing the front portion of said upper about the wearer's ankle and having a forward end attached to said upper;

a semirigid external heel shield encircling said heel end of said upper and having a lower end joined to said shoe; and said heel shield has a vertical slot on each side for passage of a strap therethrough.

6. The multipurpose shoe of claim 3, wherein said first strap has one end joined to said sole rearward of said tongue and said second strap has one end joined to said shoe forwardly of said heel end, whereby attachment of said unattached ends of said first and second strap tightens said upper about said foot.

7. The multipurpose shoe of claim 3, wherein one said unattached end has a simple buckle attached thereto, and the other said unattached end has panels of self-attachment hook and loop materials attached thereto, wherein said other unattached end is configured to be threadable through said simple buckle and doubled upon itself to join said hook panel to said loop panel and tighten said upper about said foot.

8. An integral in-line skate frame, comprising:

a skate blade comprising a pair of parallel longitudinal blade members spaced apart for attachment of ground-engaging members therebetween, said blade members connected by integral transverse reinforcement members, said blade members having an upper surface configured for placement of a footbed liner thereon for supporting a shoe;

a peripheral wall encircling said upper surface, said wall extending upwardly to enclose the rear portion of said shoe;

lateral walls extending upwardly and outwardly from said skate blade member to intersect said peripheral wall, said walls forming a generally hollow space therebetween;

transverse reinforcement ribs joining said lateral walls and said parallel blade members within said hollow space and forming a planar bed therewith for placement of said footbed liner thereon;

wherein said skate blade, peripheral wall, lateral walls and transverse reinforcement ribs comprise an integral rigid assembly; and a detent projecting upwardly from said upper surface above said footbed liner to communicatingly insert into an aperture in the bottom of said sole rearward of a toe of said sole.

9. An integral in-line skate frame, comprising:

a skate blade comprising a pair of parallel longitudinal blade members spaced apart for attachment of ground-engaging members therebetween, said blade members connected by integral transverse reinforcement members, said blade members having an upper surface configured for placement of a footbed liner thereon for supporting a shoe;

a peripheral wall encircling said upper surface, said wall extending upwardly to enclose the rear portion of said shoe;

lateral walls extending upwardly and outwardly from said skate blade member to intersect said peripheral wall, said walls forming a generally hollow space therebetween;

transverse reinforcement ribs joining said lateral walls and said parallel blade members within said hollow space and forming a planar bed therewith for placement of said footbed liner thereon;

wherein said skate blade, peripheral wall, lateral walls and transverse reinforcement ribs comprise an integral rigid assembly.

10. In combination, an in-line skate frame and a shoe, said combination further comprising:

a skate blade comprising a pair of parallel longitudinal blade members spaced apart for attachment of ground-engaging members therebetween said blade members connected by integral transverse reinforcement members, said blade members having an upper surface configured for placement of a footbed liner thereon for supporting a shoe;

a peripheral wall encircling said upper surface and configured to enclose the outer rim of a sole of said shoe, said wall extending upwardly to enclose the rear portion of said shoe, said peripheral wall defining an opening sized for placement of said shoe on said liner;

lateral walls extending upwardly and outwardly from said skate blade member to intersect said peripheral wall, said walls forming a generally hollow space therebetween;

transverse reinforcement ribs joining said lateral walls and said parallel blade members within said hollow space and forming a planar bed therewith for placement of said footbed liner thereon;

wherein said skate blade, peripheral wall, lateral walls and transverse reinforcement ribs comprise an integral rigid assembly; and wherein said integral rigid assembly is formed from a hard plastic material by injection molding.

11. An integral in-line skate frame, comprising:

a skate blade extending from a heel end and a toe end and comprising a pair of parallel longitudinal blade members spaced apart for attachment of ground-engaging members therebetween, said blade members connected by integral transverse reinforcement members, said blade members having an upper surface configured for placement of a footbed liner thereon for supporting a shoe;

a peripheral wall encircling said upper surface and configured to enclose the outer rim of a sole of said shoe, said wall extending upwardly to enclose the rear portion of said shoe;

lateral walls extending upwardly and outwardly from said skate blade member to intersect said peripheral wall, said walls forming a generally hollow space therebetween;

transverse reinforcement ribs joining said lateral walls and said parallel blade members within said hollow space and forming a planar bed therewith for placement of said footbed liner thereon;

wherein said skate blade, peripheral wall, lateral walls and transverse reinforcement ribs comprise an integral rigid assembly;

each said rib has a front surface and a rear surface, said front planar surfaces tilted toward said heel end at angles to the vertical wherein said ribs near said toe end are tilted at a greater angle than said ribs near the rear of said skate; and wherein the angles of said front rib surfaces are approximated by:

$$Q=10+X^{1.5}/7[+/-10]$$

where Q is angle of rearward tilt, degrees and X is a distance between said rib and the rear of said footbed; and wherein the angle of rearward tilt of said rear rib surface of each said rib is less than the angle Q of said front rib surfaces.

* * * * *